US009573856B2

(12) United States Patent
Currano et al.

(10) Patent No.: US 9,573,856 B2
(45) Date of Patent: Feb. 21, 2017

(54) CARBON NANOTUBE EXPLOSIVES

(75) Inventors: Luke M. Currano, Columbia, MD (US); Madan Dubey, South River, NJ (US); Ronald G. Polcawich, Derwood, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 557 days.

(21) Appl. No.: 13/372,720

(22) Filed: Feb. 14, 2012

(65) Prior Publication Data

US 2013/0206290 A1 Aug. 15, 2013

(51) Int. Cl.
*C06B 43/00* (2006.01)
*C06B 45/00* (2006.01)

(52) U.S. Cl.
CPC ..... *C06B 43/00* (2013.01); *C06B 45/00* (2013.01)

(58) Field of Classification Search
CPC ..... C06B 43/00; C06B 45/00
See application file for complete search history.

(56) References Cited

U.S. PATENT DOCUMENTS 7,025,840 B1 * 4/2006 Adams ..... 149/108.2

* cited by examiner

*Primary Examiner* — Aileen B Felton
(74) *Attorney, Agent, or Firm* — Alan I. Kalb

(57) ABSTRACT

A micro-explosive material is provided. The micro-explosive material can include a carbon nanotube and a solid oxidizer attached to the carbon nanotube. The carbon nanotube with the solid oxidizer attached thereto is operable to burn per an exothermic chemical reaction between the carbon nanotube and the solid oxidizer such that a controlled burn and/or an explosive burn is provided. The micro-explosive material can be used as a heat generator, a gas generator, a micro-thruster, a primer for use with a larger explosive material, and the like.

4 Claims, 5 Drawing Sheets

CARBON NANOTUBE EXPLOSIVES

GOVERNMENT INTEREST

The invention described herein may be manufactured, used, and licensed by or for the United States Government.

FIELD OF THE INVENTION

The present invention relates in general to an explosive material, and in particular to a carbon nanotube plus solid oxidizer explosive material.

BACKGROUND OF THE INVENTION

Explosive materials and their use to destroy, move, and/or manipulate components, devices, etc. are known. Such explosive materials typically undergo an exothermic chemical reaction that produces heat and/or a large volume of gas. In addition, the chemical reaction occurs at a rapid rate such that a shockwave propagates from the chemical reaction.

The use of explosive materials is critical in a variety of areas such as military operations, espionage operations, counter-espionage operations, movement of desired devices, and the like. In addition, the ability to precisely control quantity of explosive and the amount of energy released can provide for more accurate, reliable, and controllable effects. Therefore, a micro-explosive device and/or material would be desirable.

SUMMARY OF THE INVENTION

A micro-explosive material is provided. The micro-explosive material can include a carbon nanotube and a solid oxidizer attached to or arranged in close proximity to the carbon nanotube. The carbon nanotube combined with the solid oxidizer is operable to burn per an exothermic chemical reaction between the carbon nanotube and the solid oxidizer such that a controlled burn and/or an explosive burn is provided.

The solid oxidizer can be a salt that is attached to or in close proximity to an outer surface or wall of a carbon nanotube, to an inner wall of a hollow carbon nanotube, or combinations thereof. In the alternative, the carbon nanotube with the solid oxidizer attached thereto can afford a micro-thruster, and the micro-thruster can be attached to a micro-device such as a micro-robot, a micro-satellite, a small-caliber ballistic, etc. In some instances, the carbon nanotube and the solid oxidizer can be a generator such as a heat generator, a gas generator, a shockwave generator, and the like. In other instances, the carbon nanotube and the solid oxidizer attached thereto can be a primer charge that is operable to ignite a separate and possibly a larger explosive material.

The micro-explosive material can also include a plurality of carbon nanotubes with a solid oxidizer attached thereto. The solid oxidizer can be attached to outer surfaces of the carbon nanotubes and/or attached to inner walls if the plurality of carbon nanotubes are hollow carbon nanotubes. It is appreciated that the plurality of carbon nanotubes and the solid oxidizer can also be used as a micro-thruster, a generator, a primer, and the like in order to afford movement of a micro-device and/or destruction of at least a portion of a micro-device.

A process for producing the micro-explosive material is also provided, the process including providing a carbon nanotube and a solid oxidizer. The solid oxidizer is attached to the carbon nanotube with the carbon nanotube plus solid oxidizer operable to exothermally chemically react with each other to provide a controlled and/or explosive burn.

The carbon nanotube and/or solid oxidizer can be provided by a micro-fabrication technique and, as such, the micro-explosive material can be well suited for manufacture using techniques known to those skilled in the art of semiconductor and semiconductor device production and/or fabrication. The micro-explosive material and the process for producing a micro-explosive material can further include an electronic and/or optical initiator mechanism that is used to ignite the chemical reaction between the carbon nanotube and the solid oxidizer.

DETAILED DESCRIPTION OF THE INVENTION

Figure 1A:
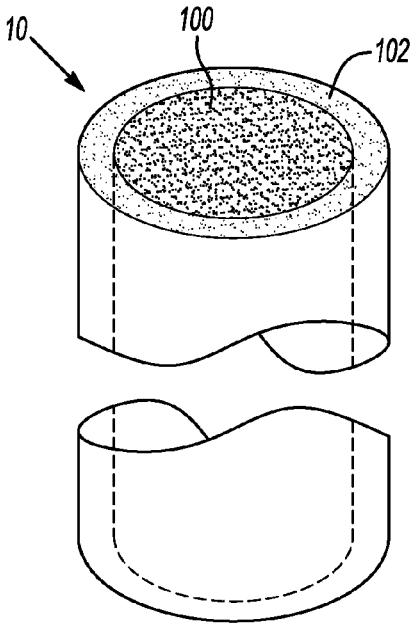
FIG. 1 is a schematic illustration of embodiments for: (A) a carbon nanotube with a solid oxidizer attached to an outer surface thereof; and (B) a hollow carbon nanotube with a solid oxidizer attached to an inner hollow tube wall thereof.

The micro-explosive material disclosed herein has utility as a micro-thruster, a micro-generator, and/or a micro-explosive. The micro-explosive material can include a carbon nanotube and a solid oxidizer attached thereto. The carbon nanotube and the solid oxidizer, are selected to afford an exothermic chemical reaction and provide a controlled burn and/or an explosive burn. The solid, oxidizer can be a salt, a fluorocarbon, or any other type of oxidizer known in the art. and may be attached to an outer surface of the carbon nanotube and/or to an inner wall of the carbon nanotube in the event that the nanotube is a hollow carbon nanotube. The carbon nanotube with the solid oxidizer attached thereto can be used for and/or provide a micro-thruster that is attached to a micro-device such as a micro-robot, a micro-satellite, a small-caliber ballistic, etc. Furthermore, the carbon nanotube with the solid oxidizer attached thereto can be a micro-generator that generates heat, gas, a shockwave, etc.

The carbon nanotube with the solid oxidizer attached thereto can also be used as a primer charge that is operable to ignite a separate explosive material. It is appreciated that the separate explosive material can be a larger amount of explosive material.

In some instances, a plurality of carbon nanotubes with solid oxidizer attached thereto can be provided and used to provide a micro-thruster, a micro-generator, a primer charge, and the like.

A process for producing the micro-explosive material is also provided, the process including providing a carbon nanotube, a solid oxidizer and attaching the solid oxidizer to the carbon nanotube. An electronic initiator mechanism and/or an optical initiator mechanism can also be included for the purpose of igniting the micro-explosive material.

It is appreciated that the burning of the carbon nanotube is the result of an exothermic chemical reaction between the carbon of the nanotube and the oxygen contained within the solid oxidizer. The solid oxidizer can be in the form of a salt such as potassium nitrate ($KNO_3$), sodium perchlorate ($NaClO_4$), etc.; however, this is not required. Stated differently, any solid oxidizer that provides sufficient oxygen to react with a carbon nanotube and provides a self-propagating exothermic chemical reaction can be used.

The micro-explosive material can afford for a low or high explosion, a low explosion resulting from rapid burning of the carbon nanotube, and a high explosion resulting from detonation of the micro-explosive material. More particularly, the micro-explosive material can provide for deflagration, i.e. the decomposition of the micro-explosive material by propagation of a flame front. In the alternative, the micro-explosive material can result in detonation, i.e. the decomposition of the carbon nanotube and solid oxidizer by propagation of an explosive shockwave traversing the material. It is appreciated that the propagation of the flame front through the micro-explosive material is relatively slow compared to the propagation of the shockwave through the material via detonation. In addition, it is further appreciated that physical and/or chemical properties/characteristics of the carbon nanotubes and the solid oxidizer can be selected such that a desired burn rate, deflagration rate, detonation rate, and the like is provided.

Figure 1B:
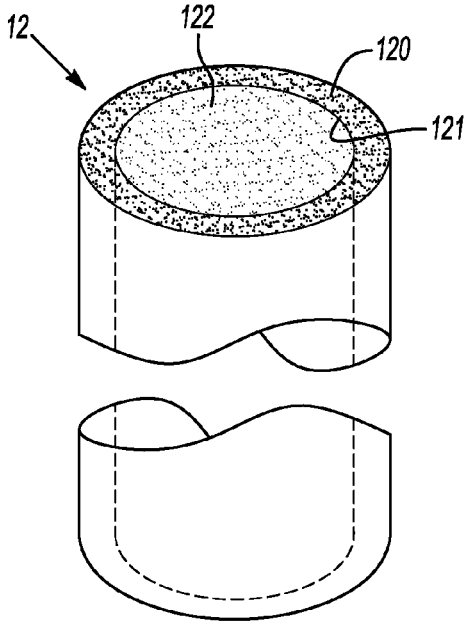

Turning now to FIG. 1, two embodiments of a micro-explosive material are shown. FIG. 1A illustrates an embodiment 10 in which a solid carbon nanotube 100 has a solid oxidizer 102 attached to an outer surface of the carbon nanotube 100. In the alternative, FIG. 1B illustrates an embodiment 12 in which a hollow carbon nanotube 120 with a solid oxidizer 122 embedded or attached within the hollow nanotube 120 and in contact with an inner wall 121. It is appreciated that the solid oxidizer shown in FIG. 1 can react with the carbon nanotube to provide an exothermic chemical reaction that propagates or occurs at a desired rate.

Figure 2:
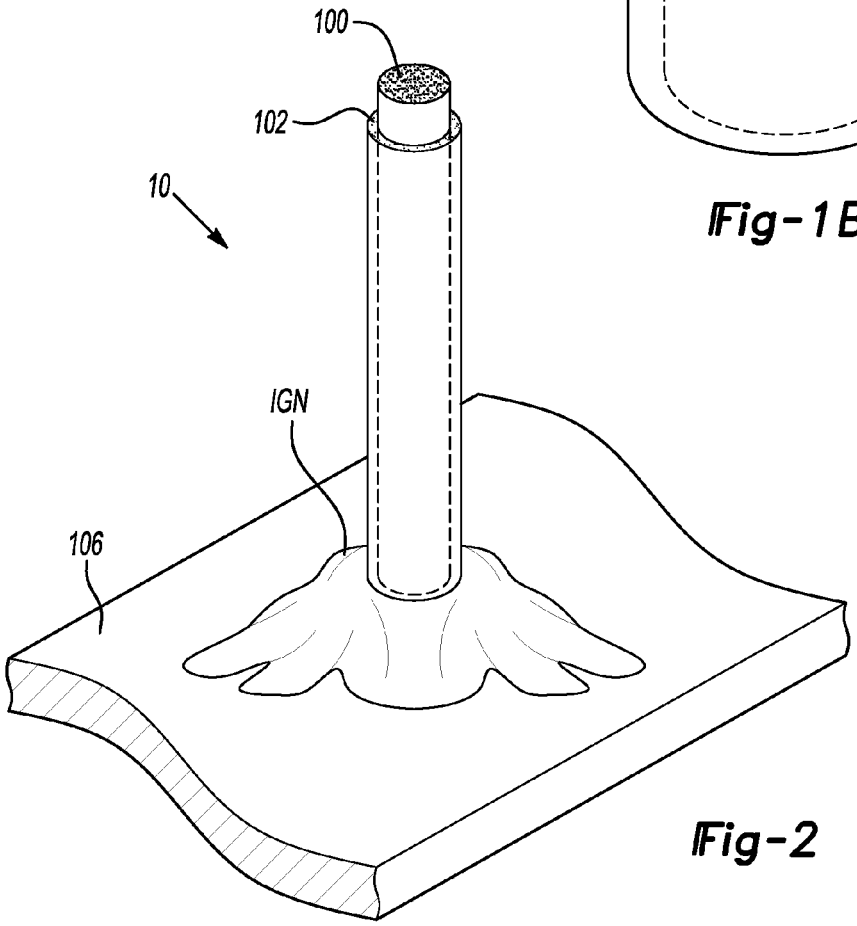
FIG. 2 is a schematic illustration of a micro-explosive material after ignition.

FIG. 2 illustrates the embodiment 10 having been ignited and in the process of providing a controlled burn or an explosion. It is appreciated that the ignition IGN is afforded by an initiator mechanism 106. The initiator mechanism 106 can be an electronic initiator mechanism, a chemical initiator mechanism, an optical initiator mechanism, and the like.

Figure 3:
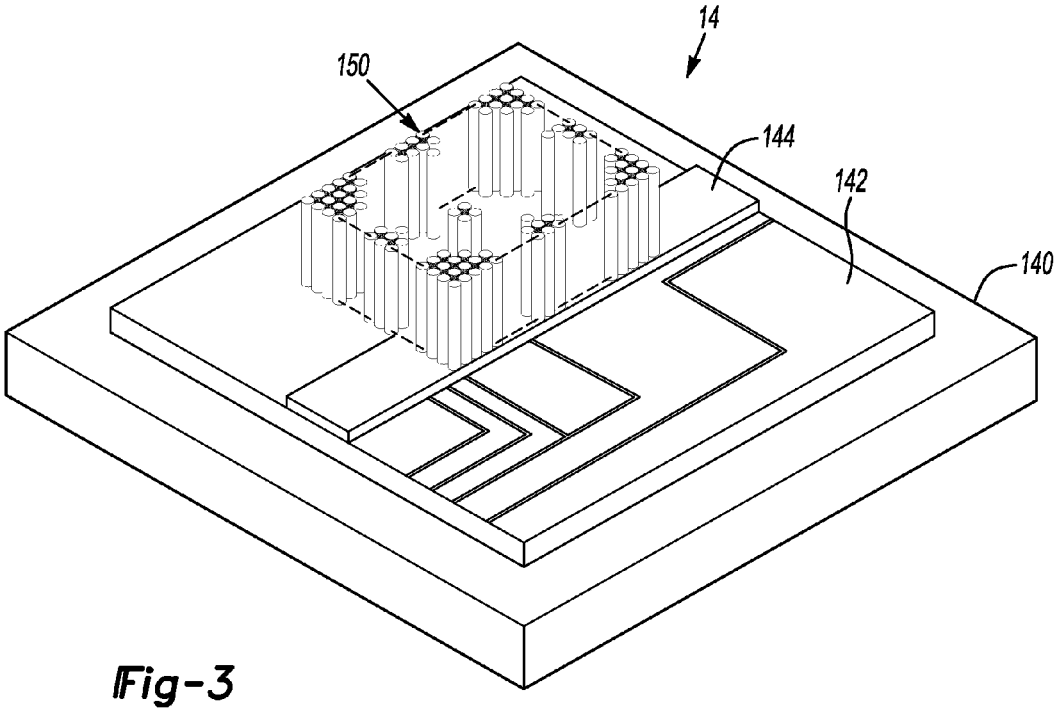
FIG. 3 is a schematic illustration of a plurality of nanotubes with solid oxidizer attached thereto and located on a micro-device.

Turning now to FIG. 3, an embodiment 14 having micro-explosive material attached to a micro-device is shown. In particular, a substrate 140 with an integrated circuit 142 attached thereto is shown. The integrated circuit can be part of an electronic device such as a computer, personal digital assistant (PDA), audio equipment, broadcast equipment, marine electronics, power electronics, printed circuit boards, robotic equipment, and the like.

In addition to the substrate 140 and integrated circuit 142, a plurality of nanotubes and solid oxidizer 150 with an initiator 144 can be included such that initiation of an exothermic chemical reaction of the plurality of carbon nanotubes with oxidizer 150 is afforded. In this manner, a relatively small area or volume of a micro-device can be burned, heated, melted, etc. with minimum impact to surrounding areas, as in applications such as microwelding or thermally initiated thin film batteries.

Figure 4:
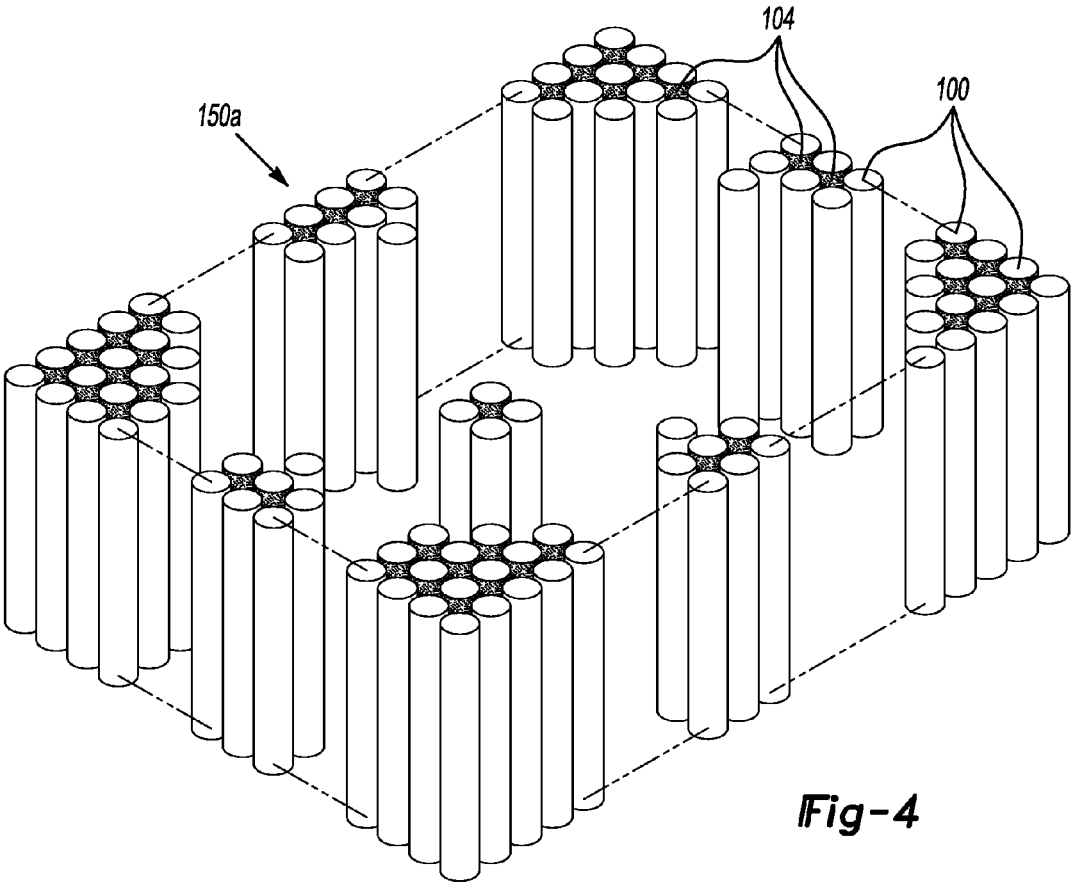
FIG. 4 is a schematic illustration of a plurality of carbon nanotubes with a solid oxidizer attached to an external surface thereof.

Looking at the plurality of carbon nanotubes with solid oxidizer 150 in greater detail, FIG. 4 shows embodiment 150*a* in which a plurality of solid carbon nanotubes 100 is arranged in a bundle with a solid oxidizer 104 embedded within or between the nanotubes 100. It is appreciated that the embodiment or bundle 150*a* provides a micro-explosive material that can be initiated and afford for the solid oxidizer 104 to react With the carbon of the carbon nanotubes 100.

Figure 5:
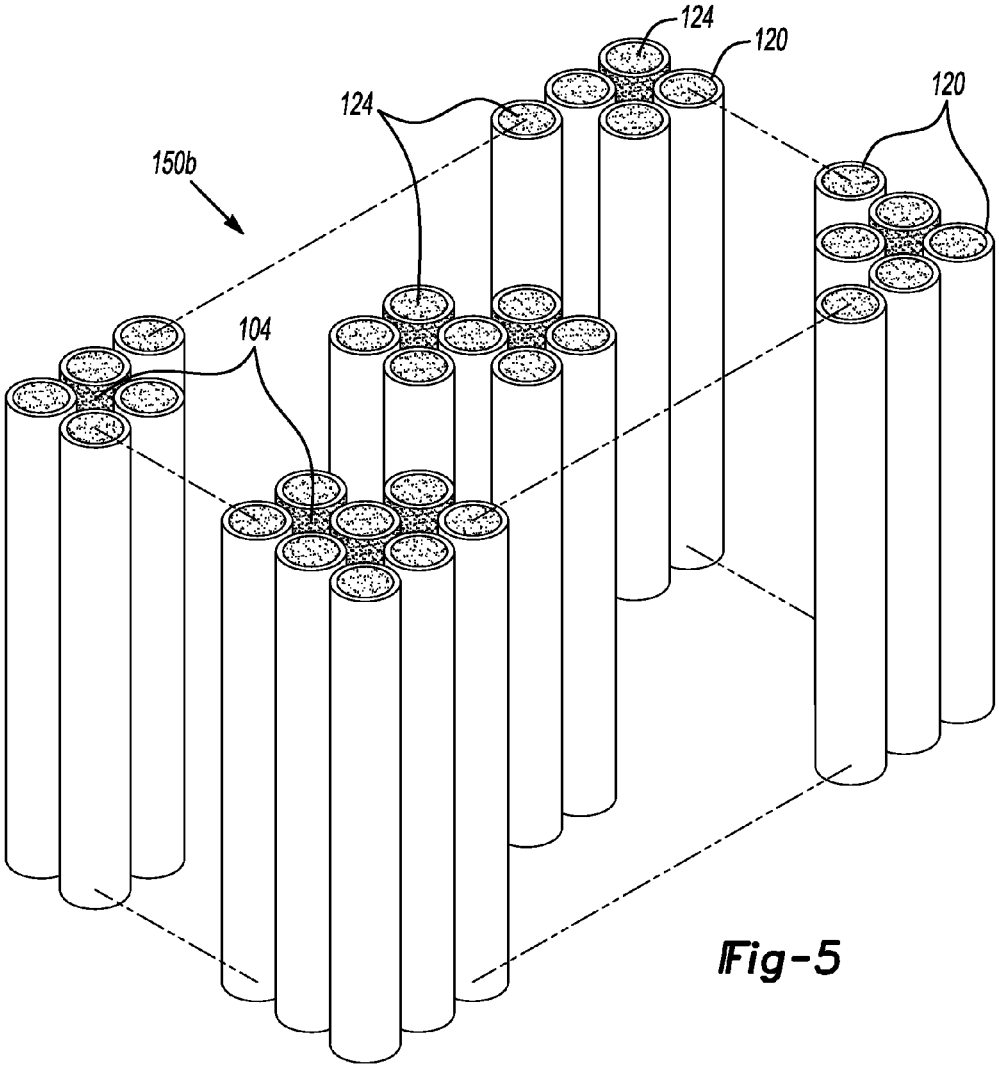
FIG. 5 is a schematic illustration of a plurality of hollow carbon nanotubes with a solid oxidizer attached to an inner wall thereof.
Figure 6A:
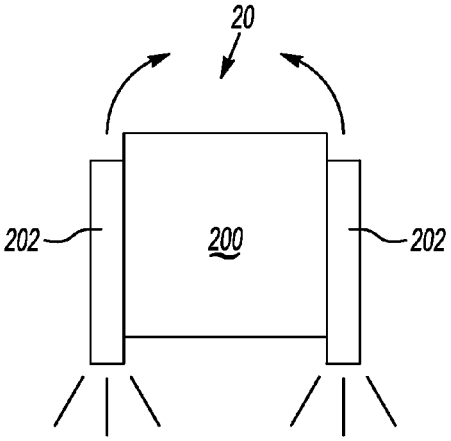
FIG. 6 is a schema& illustration of embodiments for: (A) a micro-thruster attached to a micro-device; (B) a micro-thruster attached to a small-caliber ballistic; (C) a micro-heat generator used to boil a liquid on an electronic chip; and (D) a primer attached to a larger explosive.
Figure 6B:
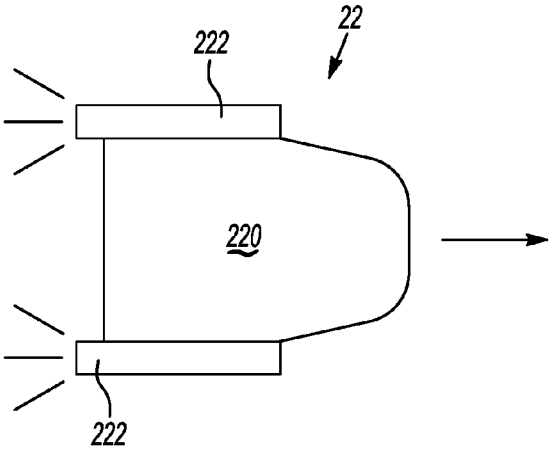
Figure 6C:
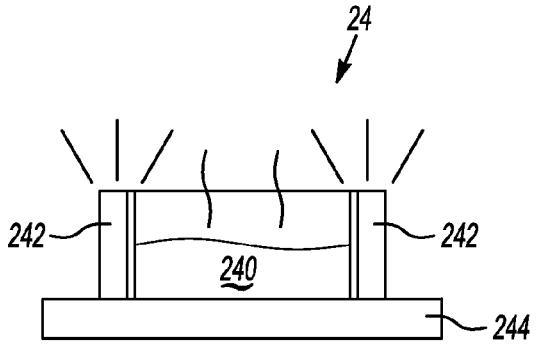
Figure 6D:
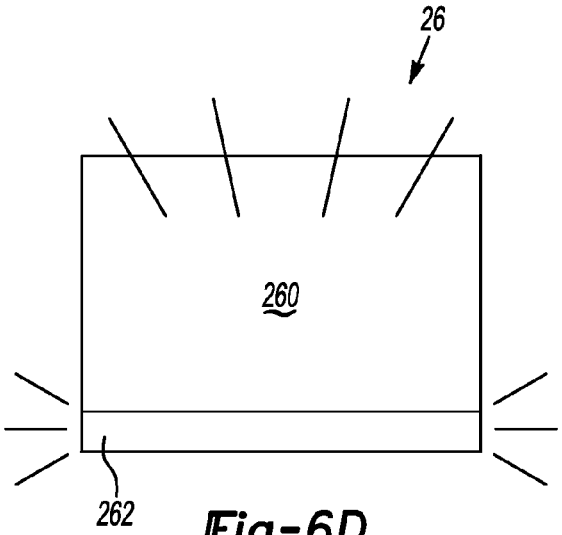

FIG. 5 illustrates another embodiment 150*b* in which the carbon nanotubes are hollow carbon nanotubes 120 and a solid oxidizer 124 is located or embedded within at least a portion of the nanotubes 120. Optionally, solid oxidizer 104 can also be located or embedded between the carbon nanotubes 120 and it is appreciated that hollow carbon nanotubes 120 with only solid oxidizer 104 embedded therebetween can be provided. It is also appreciated that initiation of a chemical reaction between the solid oxidizer and the carbon nanotubes by an initiation mechanism can provide a desired amount of heat, explosion, and the like, which can damage or destroy a portion or all of the integrated circuit 142.

For example and for illustrative purposes only, the carbon can react with a solid oxidizer according to the reaction:

$$2(KNO_3)+S+3C \rightarrow K_2S+N_2+3(CO_2)$$

in which sulfur can be added to assist in a gunpowder-like reaction. It is appreciated that the sulfur can be present as a coating on the carbon nanotubes, as part of the initiation mechanism, as part of the solid oxidizer, as a vapor, and the like. In the alternative, a solid oxidizer that does not require the presence of sulfur, e.g. $NaClO_4$, in order for a desired exothermic chemical reaction to occur can be used.

The micro-explosive material disclosed herein can have a plurality of uses, illustratively including the embodiments shown in FIG. 6. For example, an embodiment 20 can include one or more carbon nanotubes with solid oxidizer attached thereto 202 attached to a micro-device 200 in order to afford a micro-thruster for movement of the device 200 as shown by the arrows. In the alternative, an embodiment 22 shown in FIG. 6B can include one or more micro-thrusters 222 attached to a micro-caliber ballistic 220 to afford movement thereof. It is appreciated that the one or more micro-thrusters 222 can oriented at angle relative to the micro-caliber ballistic, e.g. perpendicular to a flight direction, in order to "steer" the ballistic and the orientation shown in FIG. 6B, as for the other figures, is for illustrative purposes only. FIG. 6C shows one or more heat generators 242 made from a carbon nanotube with a solid oxidizer attached thereto which can be used to heat and/or boil a liquid 240 that is present on an electronic chip 244 and allow for chemical analysis of the liquid 240 as is known to those skilled in the art. And FIG. 6D illustrates a primer 262 made from at, least one carbon nanotube with a solid oxidizer attached thereto, the primer 262 affording for ignition of a separate and larger explosive material 260.

Figure 7:
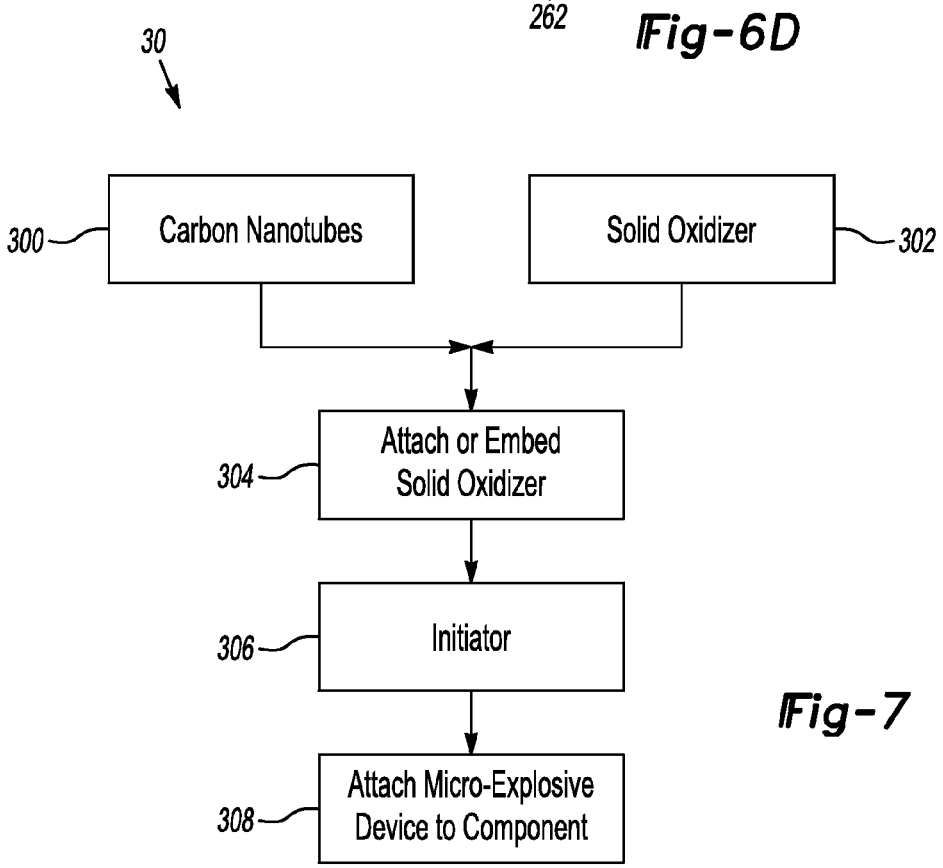
FIG. 7 is a schematic diagram of a process according to an embodiment of the present invention.

A process for producing the micro-explosive material is shown generally at reference numeral 30 in FIG. 7. The process 30 can include providing one or more carbon nanotubes at step 300 and providing a solid oxidizer at step 302. Thereafter, the solid oxidizer is attached or embedded around or within, respectively, the one or more carbon nanotubes at step 304. Optionally, an initiator 306 can be provided and the material from step 304 and/or the initiator 306 providing a micro-explosive device that can be attached to a component at step 308. The process can also include ignition of the micro-explosive device in order to provide a desired function relative to the component. For example, melting, vaporization, heating and/or movement of at least part of the component can be afforded.

The attachment or embedding of solid oxidizer can be accomplished in a number of ways, including but not limited to exposing the carbon nanotubes to a liquid solution of the oxidizer by dropcasting, soaking, spray-coating, etc, then allowing the solvent to sublimate or evaporate away; gas-phase-deposition via evaporation or sputtering of the oxidizer material onto the carbon nanotubes; and producing the oxidizer on the chip by reacting one or more chemicals with the substrate or each other.

In order to better explain an embodiment of the micro-explosive material and a process for providing the micro-explosive material, and yet not limit the scope of the invention in any way, an example is provided below.

EXAMPLE

Multiwalled carbon nanotubes were produced using a thermal chemical vapor deposition technique which exposed a mixture of ferrocene and xylene vapor to a patterned $SiO_2$/Si substrate in a quartz tube furnace. The substrate within the quartz tube was held at 770° C. and the gas mixture was allowed to flow through the tube for times between 30 to 60 minutes. Before passing the ferrocene-xylene gas mixture through the quartz, argon gas at a pressure of approximately 100 mTorr was present to prevent the patterned $SiO_2$/Si substrate surface from oxidizing. Then, and after the furnace was heated to the deposition temperature of 770° C., a solution of ferrocene (0.5 mg) in xylene (50 mL) was pre-vaporized at 180° C. and introduced into a quartz tube and allowed to flow over the substrate. It is appreciated that the pre-vaporized ferrocene/xylene mixture served as both a carbon source and a catalyst with the xylene providing the carbon atoms and iron from the ferrocene serving as the catalyst for multiwalled carbon nanotube growth.

After a desired exposure time had elapsed, the reaction terminated by stopping the flow of the ferrocene/xylene gas mixture flow while passing $H_2$/Ar gas through the furnace tube to remove or blow away any residual hydrocarbon vapor. In this manner, the reaction time for the growth of the carbon nanotubes was well controlled.

The above-described process provided mats of carbon nanotubes which were then heated in air at 350° C. for 2 hours to remove any carbonaceous impurities. The air-oxidized samples were further purified by exposure to concentrated nitric acid ($HNO_3$) for 24 hours in order to remove any catalytic impurities. It is appreciated that hydrophobic carbon nanotubes will change to hydrophilic material upon nitric acid treatment due to the attachment of —OH functional groups at defective sites.

The resulting nitric acid treated carbon nanotubes were then washed with de-ionized water several times and dried in vacuum at 500° C. for 4 hours. After washing and drying, the nitric acid treated carbon nanotubes were then exposed to a 1 M sodium perchlorate ($NaClO_4$) solution at room temperature for 24 hours. This end product was then dried again in vacuum at 100° C. for 24 hours.

Various analyses were conducted on the as-prepared mats of carbon nanotubes, the nitric acid treated carbon nanotubes, and the final end product using techniques such as x-ray diffraction, scanning electron microscopy, Raman spectroscopy, Fourier transform infrared spectroscopy, and x-ray photoelectron spectroscopy. In addition, the results clearly demonstrated that sodium perchlorate was attached to the carbon nanotubes that had been exposed to the $NaClO_4$ solution.

In order to investigate the thermal stability and heat flow properties of the carbon nanotube-sodium perchlorate samples, thermogravimetric analysis (TGA) and differential scanning calorimetry (DSC) were performed thereon. In particular, samples weighing approximately 10 mg were heated in an air atmosphere from 30° C. to 1000° C. at a rate of 5° C./min and the weight of a given sample was recorded as a function of temperature.

Figure 8A:
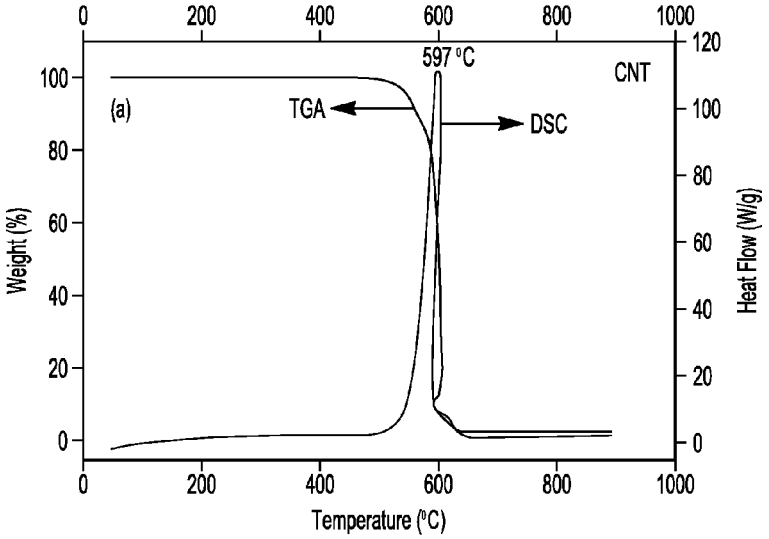
FIG. 8 is a series of graphical plots from data provided by Dr. Arava Leela Mohana Reddy and Dr. Pulickel M. Ajayan at Rice University for the thermal stability and heat flow properties of: (A) carbon nanotubes; (B) carbon nanotubes treated with nitric acid ($HNO_3$); and (C) carbon nanotubes treated with $HNO_3$ and further treated with sodium perchlorate ($NaClO_4$) (*J. Nanoscience and Nanotechnoloky* 11, pp. 1111-1116, 2011).
Figure 8B:
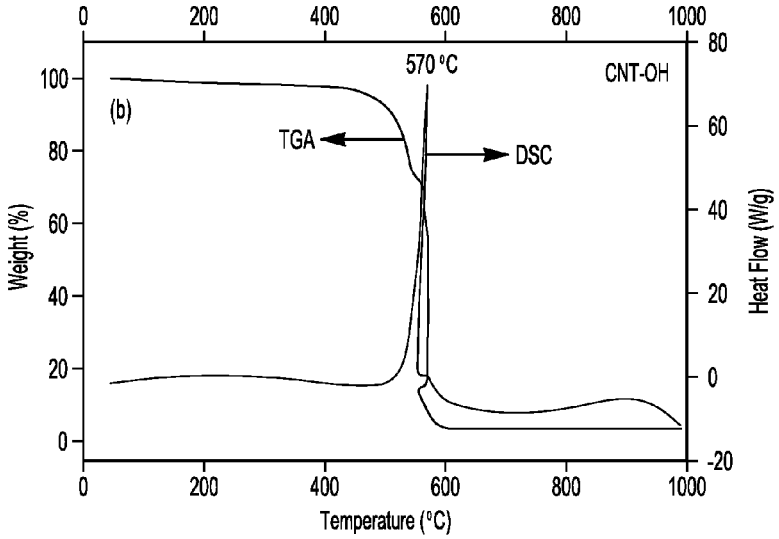
Figure 8C:
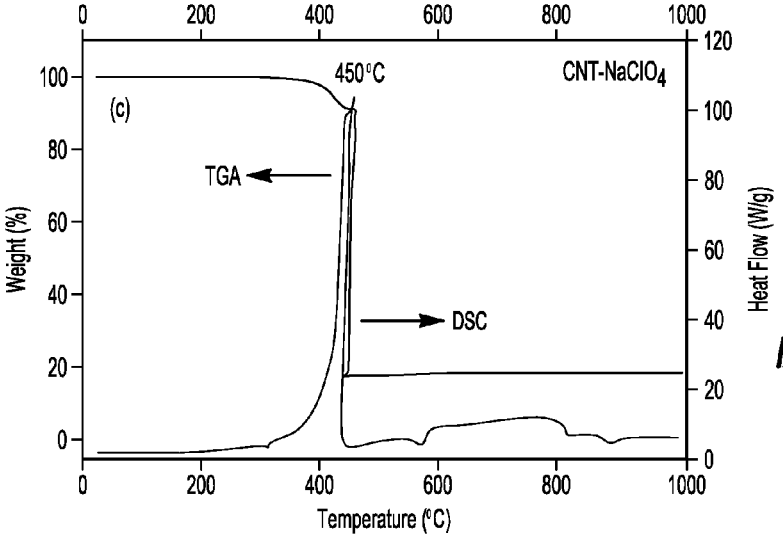

Looking at FIG. 8, TGA and DSC curves for Samples of as-produced carbon nanotubes (CNT) are shown in FIG. 8A; nitric acid treated carbon nanotubes (CNT-OH) are shown in FIG. 8B; and carbon nanotubes with the solid oxidizer sodium perchlorate attached thereto (CNT-$NaClO_4$) are shown in FIG. 8C. As shown in FIGS. 8A-8C, the DSC curves show exothermic peaks at 597, 570 and 450° C. for the carbon nanotube, nitric acid treated carbon nanotubes, and sodium perchlorate treated carbon nanotubes, respectively. It is appreciated that the significant decrease in the temperature onset of the exothermic peak for the sodium perchlorate treated carbon nanotubes (i.e. 450° C. versus 570 and 597° C.) illustrates that the presence of the solid oxidizer destabilizes the carbon nanotubes. Not being bound by theory, it is proposed that oxygen from the sodium perchlorate triggers the exothermic reaction with the carbon nanotubes and can provide for a micro-explosive material.

The foregoing description is illustrative of particular embodiments of the invention, but is not meant to be a limitation upon the practice thereof. The following claims, including all equivalents thereof, are intended to define the scope of the invention.

We claim:

1. An explosive material comprising:

a plurality of hollow carbon nanotubes; and an oxygen-containing salt based solid oxidizer attached to an inner wall of an outer surface of said hollow carbon nanotubes, said carbon nanotubes and said solid oxidizer attached thereto operable to react exothermically to create a micro-thruster which is attached to an electric circuit.

2. The explosive material of claim 1, wherein said micro-thruster is attached to a micro-device selected from a group consisting of a micro-robot, a micro-satellite and a small-caliber ballistic.

3. The explosive material of claim 1, wherein said carbon nanotubes and said solid oxidizer is a micro-generator selected from a group consisting of a heat generator, a gas generator and a shockwave generator.

4. The explosive material of claim 1, wherein said carbon nanotubes and said solid oxidizer is operable to produce sufficient heat to weld two materials or parts together.

* * * * *